US006419545B1

(12) United States Patent
Motosko

(10) Patent No.: US 6,419,545 B1
(45) Date of Patent: Jul. 16, 2002

(54) WATER SQUIRTING MINIATURE TOY VEHICLE

(76) Inventor: Stephen Motosko, 3535 LaPaloma Ave., Sarasota, FL (US) 34242

( * ) Notice: Subject to any disclaimer, the term of this patent is extended or adjusted under 35 U.S.C. 154(b) by 0 days.

(21) Appl. No.: 09/672,657

(22) Filed: Sep. 28, 2000

Related U.S. Application Data

(60) Provisional application No. 60/157,243, filed on Oct. 1, 1999.

(51) Int. Cl.[7] ..... A63H 3/52; A63H 23/08

(52) U.S. Cl. ..... 446/267; 446/176; 446/473; 446/487; D21/572

(58) Field of Search ..... 446/267, 7, 71, 446/149, 473, 465, 180, 176, 275; D21/487, 572, 575, 580–581

(56) References Cited

U.S. PATENT DOCUMENTS

| | | | | | |
|---|---|---|---|---|---|
| 3,578,789 | A | * | 5/1971 | Ferri | 222/79 |
| 3,658,074 | A | * | 4/1972 | Wright | 134/94 |
| 4,114,309 | A | | 9/1978 | Gay | 46/75 |
| 4,848,577 | A | * | 7/1989 | Hoffman et al. | 206/467 |
| 5,295,890 | A | | 3/1994 | Myers | |
| D348,913 | S | * | 7/1994 | Rudell | 446/473 |
| 5,474,486 | A | | 12/1995 | Chilton et al. | |
| 5,735,440 | A | * | 4/1998 | Regalbuto | 222/610 |
| 5,810,638 | A | * | 9/1998 | Wood | 446/73 |
| 6,224,457 | B1 | * | 5/2001 | Wu | 446/473 |
| 6,280,277 | B1 | * | 8/2001 | Greenberg et al. | 445/161 |

* cited by examiner

*Primary Examiner*—Alex F. R. P. Rada, III
(74) *Attorney, Agent, or Firm*—Charles J. Prescott

(57) ABSTRACT

A combination miniature toy vehicle and squirt gun. In one embodiment, the toy vehicle includes a hand grip which, when pivotally extended downwardly from the vehicle bottom, also serves as a water pump. Each time the grip is manually actuated by squeezing, a supply of water is drawn from a tank within the toy vehicle and pumped through suitable concealed conduit for discharge as streams of water through discharge nozzles located in each headlight of the model car. When the grip is in its stored position within a cavity in the bottom of the model car, a separate button shaped actuator in the top of the model car may be depressed to actuate the stored grip and thusly to discharge water streams from the headlights. In an alternate embodiment, a depressable button or body panel area directly activates a water pump in fluid communication between the water tank and the headlight water discharge nozzles.

5 Claims, 5 Drawing Sheets

FIG. 6
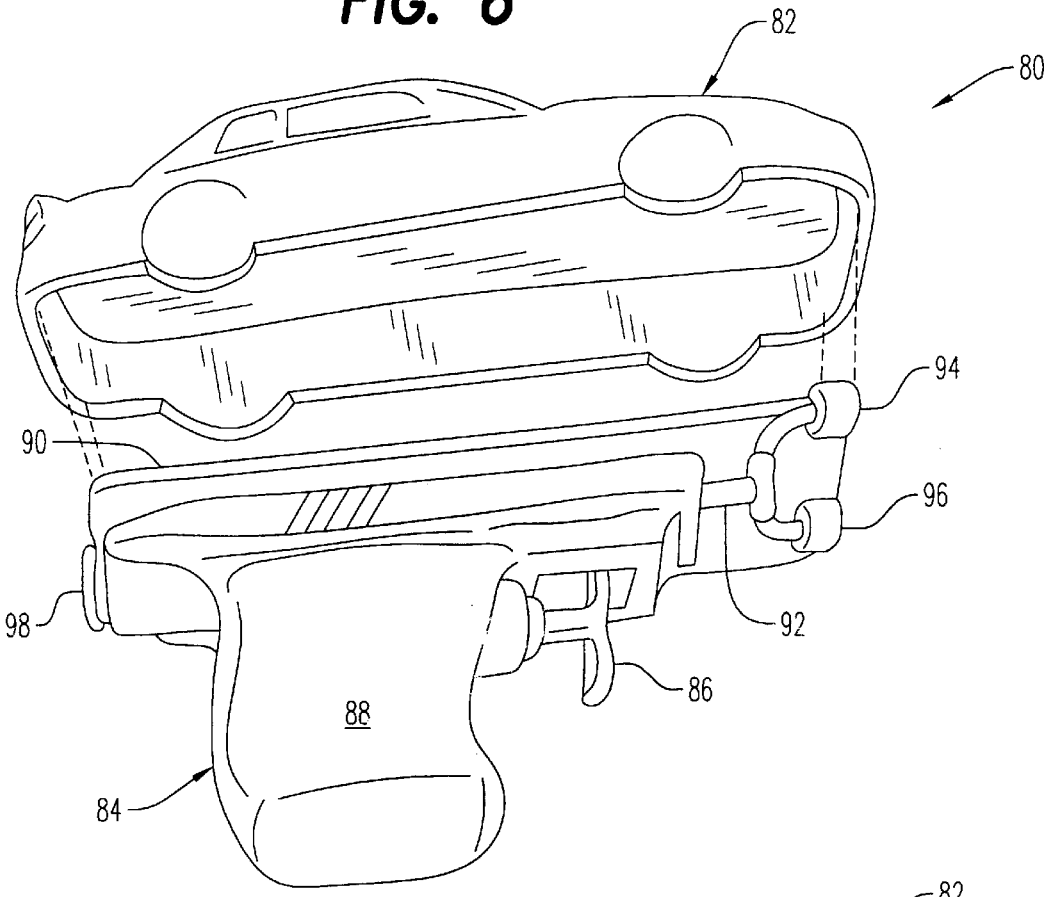
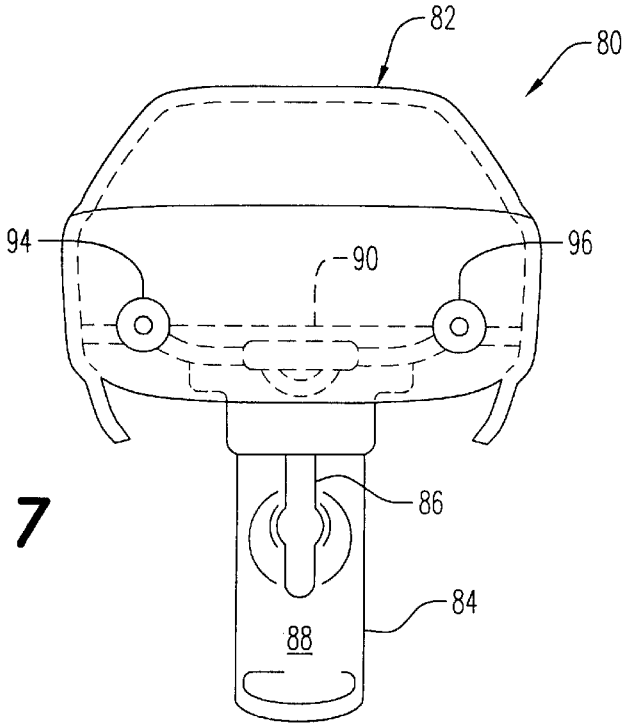
FIG. 7

WATER SQUIRTING MINIATURE TOY VEHICLE

This application claims benefit of provisional application Ser. No. 60/157243 filed Oct. 1, 1999.

BACKGROUND OF THE INVENTION

1. Scope of Invention

This invention relates generally to toy water dispensing apparatus and more particularly to a miniature model vehicle which dispenses water in squirt gun fashion through nozzles positioned in the headlights or grill of the vehicle.

2. Prior Art

The following patented prior art is known to applicant as follows:

U.S. Pat. No. 4,114,309 issued to Gay

U.S. Pat. No. 5,295,890 issued to Myers

U.S. Pat. No. 5,474,486 issued to Chilton, et al.

The '309 patent to Gay teaches a toy helicopter with a water reservoir and a dispensing nozzle attached to the front of the helicopter actuated by a trigger.

Myers, in the '890 patent teaches a toy vehicle in the form of a tank which discharges or ejects water from the simulated cannon of the vehicle.

Lastly, in '486, Chilton teaches a remote controlled transformable water squirting toy vehicle wherein the top of the vehicle pivots upward to disclose the shape of a viper which squirts water from its mouth area.

The present invention, not taught by this known prior art, teaches a miniature toy vehicle which will discharge streams of water from nozzles positioned in the grill or headlights of the vehicle when a hand gripable actuator is operated.

BRIEF SUMMARY OF THE INVENTION

This invention is directed to a combination miniature toy vehicle and squirt gun. In one embodiment, the toy vehicle includes a hand grip which, when pivotally extended downwardly from the toy vehicle, also serves as a water pump actuator. Each time the pump is manually actuated by squeezing the grip, a supply of water is drawn from a tank within the toy vehicle and pumped through suitable conduit to discharge in a stream of water through discharge nozzles located in each headlight of the toy vehicle. When the grip is in its stored position within a cavity in the bottom of the toy vehicle, a separate button shaped actuator in the top of the toy vehicle may be depressed to actuate the stored grip and thusly to cause discharge water streams from the headlights. In an alternate embodiment, a depressable button or body panel area directly activates the water pump which is in fluid communication between the water tank and the headlight water discharge nozzles.

It is therefore an object of this invention to provide a miniature toy vehicle which includes a manual pump, water reservoir and nozzles appropriately positioned for squirting water from the headlight area of the vehicle.

It is another object of this invention to provide a miniature toy vehicle having a concealable hand grip serving as a water pump when in the in-use position.

It is still another object of this invention to provide a miniature toy vehicle which discharges streams of water from the headlight area thereof in response to either of a dual actuation mode including a squeezable grip and a depressable panel on the vehicle when the grip is in the stored position.

In accordance with these and other objects which will become apparent hereinafter, the instant invention will now be described with reference to the accompanying drawings.

BRIEF DESCRIPTION OF THE DRAWINGS

FIG. 6 is a side elevation view of a simpler embodiment of the invention.

FIG. 7 is a bottom plan view of FIG. 5.

DETAILED DESCRIPTION OF THE INVENTION

Figure 1:
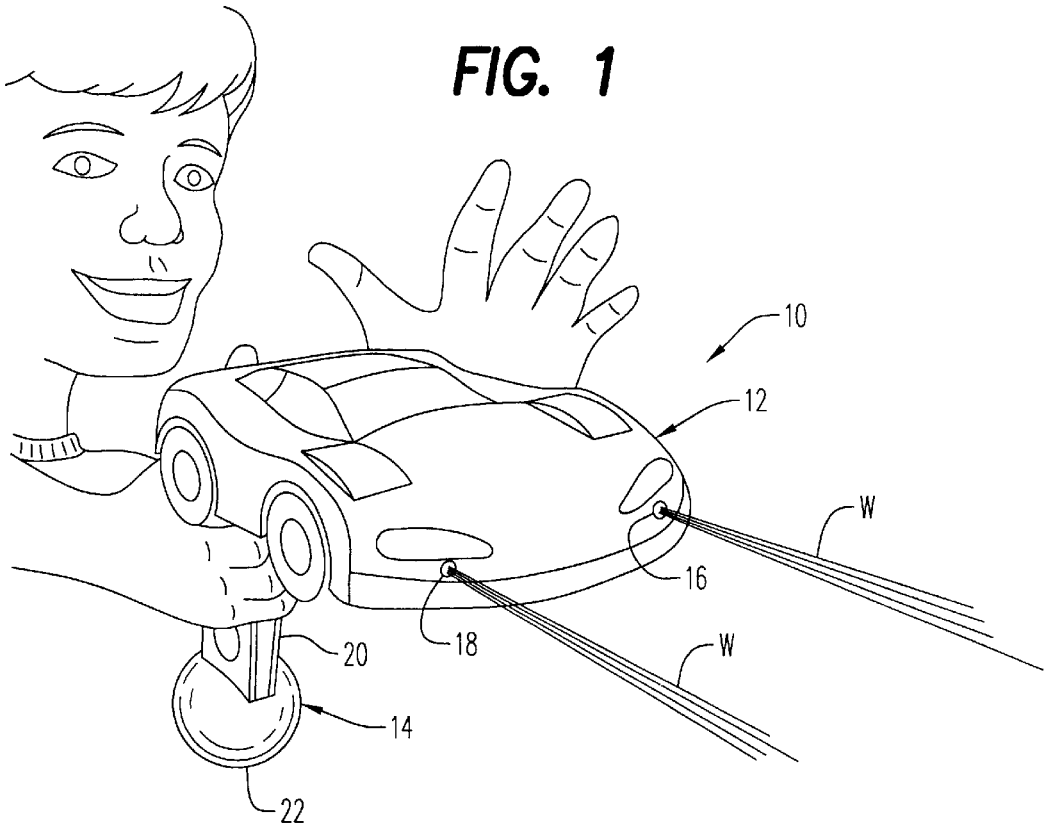
FIG. 1 is a perspective view of one embodiment of the invention.
Figure 2:
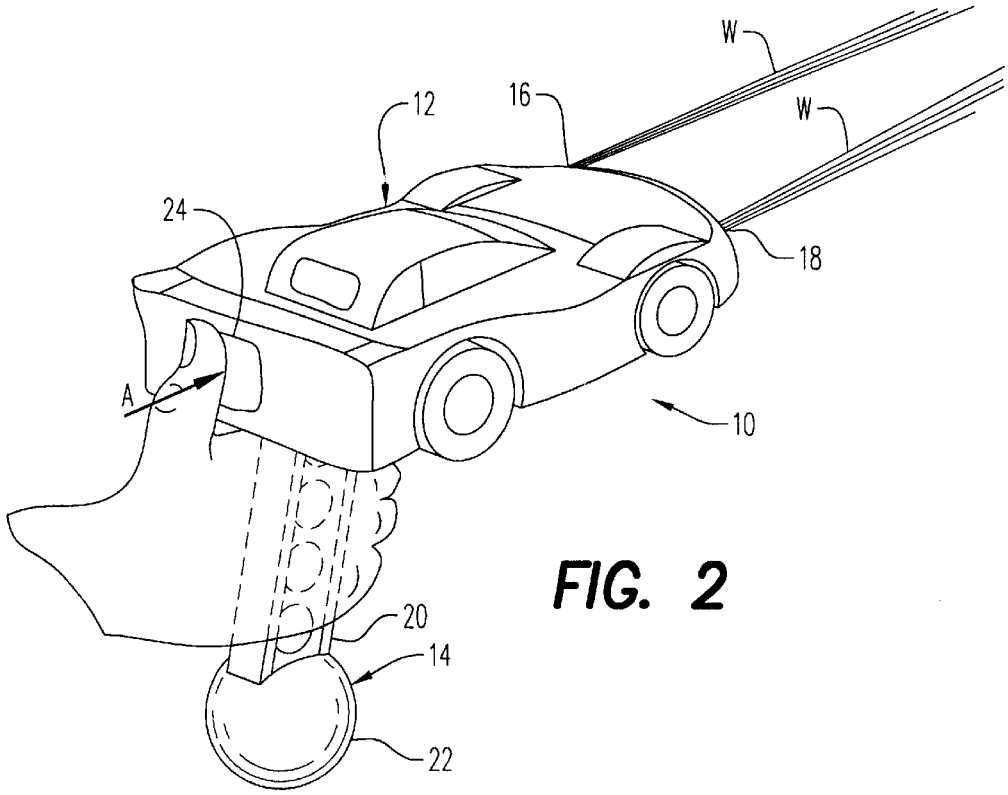
FIG. 2 is a rear perspective view of FIG. 1.

Referring now to the drawings, one embodiment of the invention is shown generally at numeral 10 in FIGS. 1 and 2. This embodiment 10 includes a thin shell plastic car body 12 having the overall configuration of a racing vehicle. A pistol type grip 10 is removably disposed from a bottom panel of the vehicle and includes an enlarged ball 22 at the distal end of the main body 20 of grip 14. This presents the appearance of a gearshift lever.

To actuate water streams W emanating from nozzles 16 and 18 positioned at the headlight area of the toy vehicle 12, a depressable panel portion 24 actuated by the thumb in the direction of arrow A when the grip 14 is held as shown, actuates a water pump (not shown) concealed within the vehicle 12 which draws water form a tank or reservoir (not shown) also concealed within the vehicle 12 to force water through appropriate flexible conduit (not shown) to the nozzles 16 and 18 which emanate streams of water at W as shown in these figures.

Figure 3:
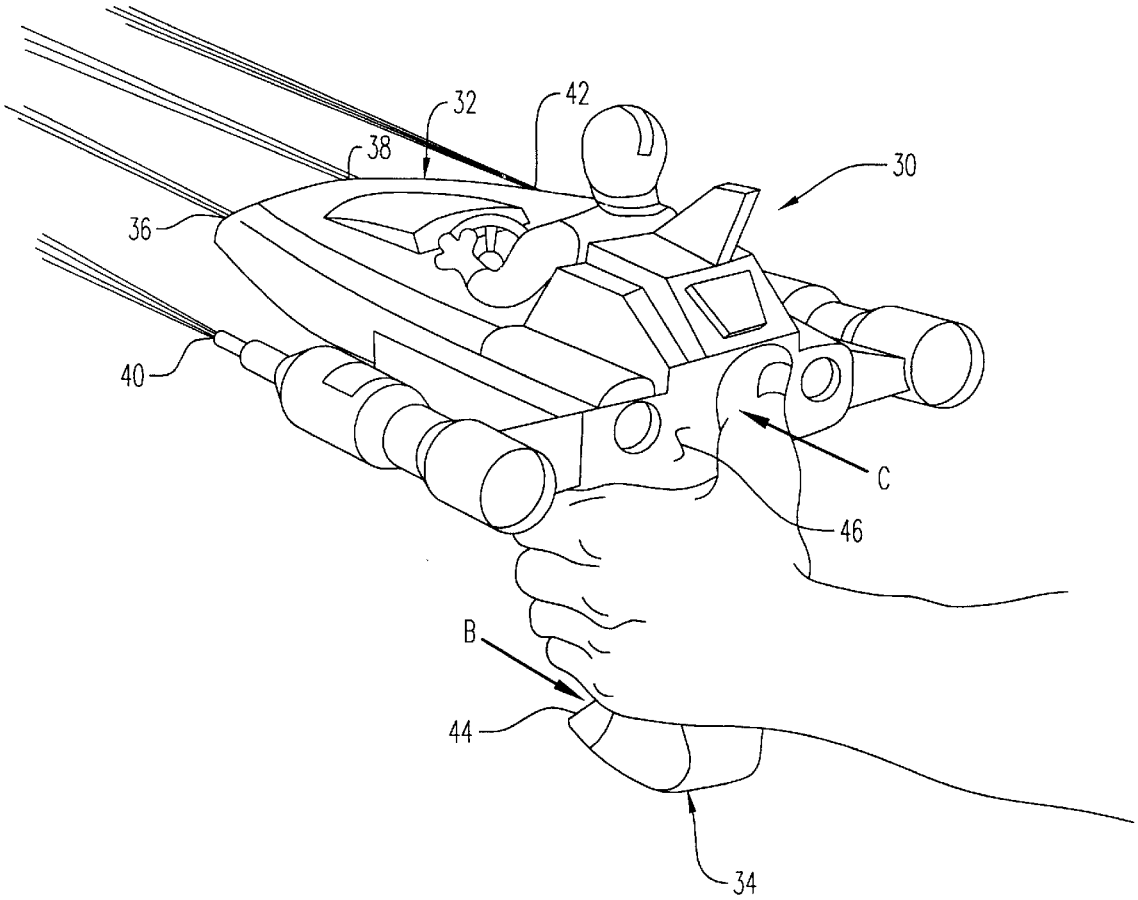
FIG. 3 is a rear perspective view of another embodiment of the invention.

Referring now to FIG. 3, another embodiment of the invention is shown generally at numeral 30 having a miniature toy vehicle 32 formed of thin molded plastic material in the form of a futuristic spacecraft. A handle or grip shown generally at 34 extends downwardly from the bottom portion of the toy vehicle 32 and is pivotally attached into the bottom of the toy vehicle 32 as will be better described herebelow.

The grip 34 includes a front pivotally mounted pumping lever 44 which, when squeezed in the direction of arrow B by the fingers of the user, causes water to be pumped from a water reservoir (not shown) concealed within the toy vehicle 32 through appropriate conduit for discharge through nozzles 36 and 38 at the headlight area of the toy vehicle 32.

In this embodiment 30, water streams also discharge through nozzles 40 and 42 positioned at the forwardly distal ends of simulated weaponry attached to either side of the toy vehicle 32. In this embodiment 30, water pump actuation may also be effected by depressing a moveable rear panel 46 in the direction of arrow C. Alternate embodiments of this invention 30 would be in the form of separate actuation of the headlight mounted nozzles at 36 and 38 from the activation of nozzles 40 and 42 at the forwardly ends of simulated weaponry. For example, the pivotal lever 44 actuated in the direction of arrow B may result in the dispensing of water through the nozzles 36 and 38, while depressing panel 46 in the direction of arrow C may activate the discharge of water though nozzles 40 and 42.

Figure 4:
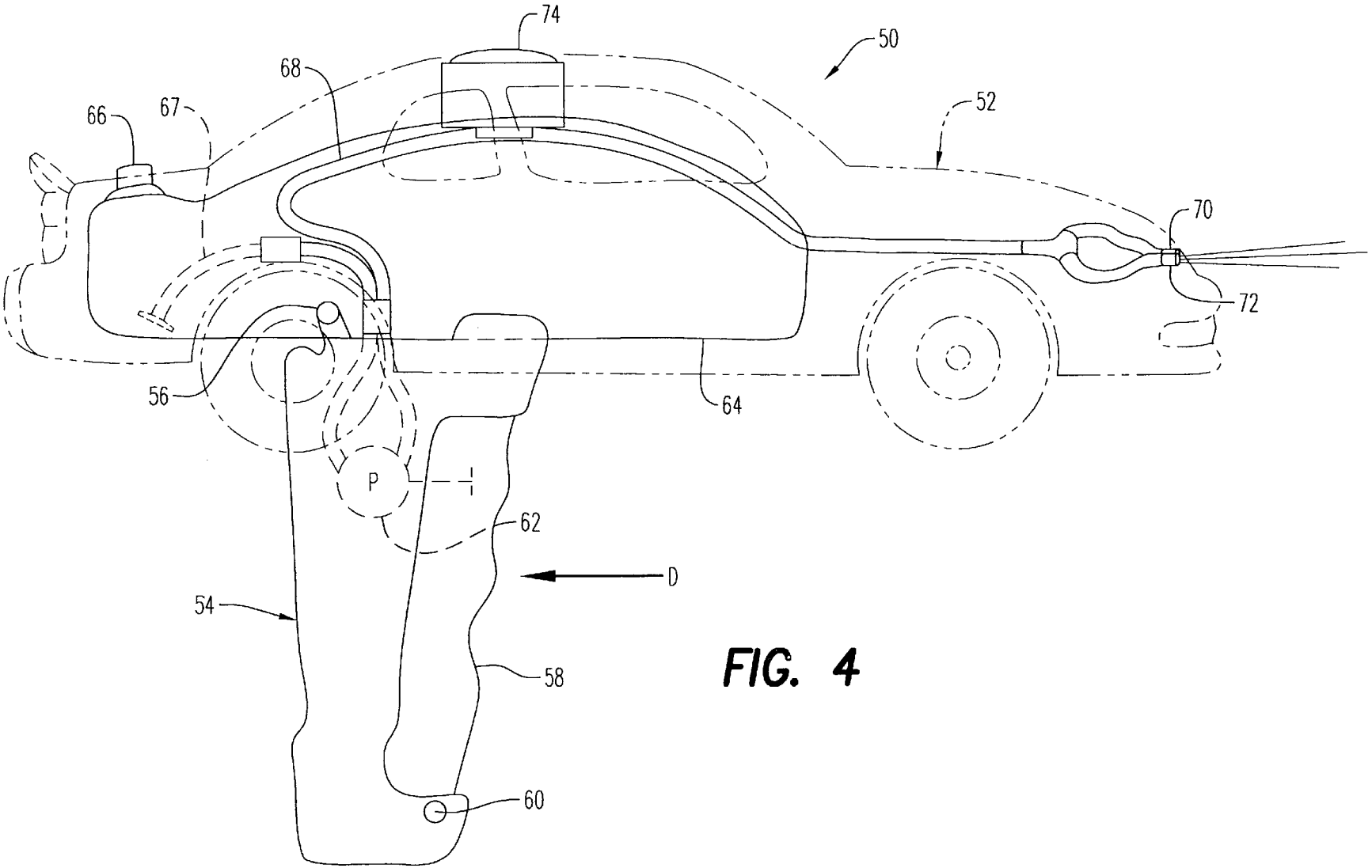
FIG. 4 is a side elevation view of the preferred embodiment of the invention showing the grip therefor in the in-use position and the body of the vehicle in phantom.
Figure 5:
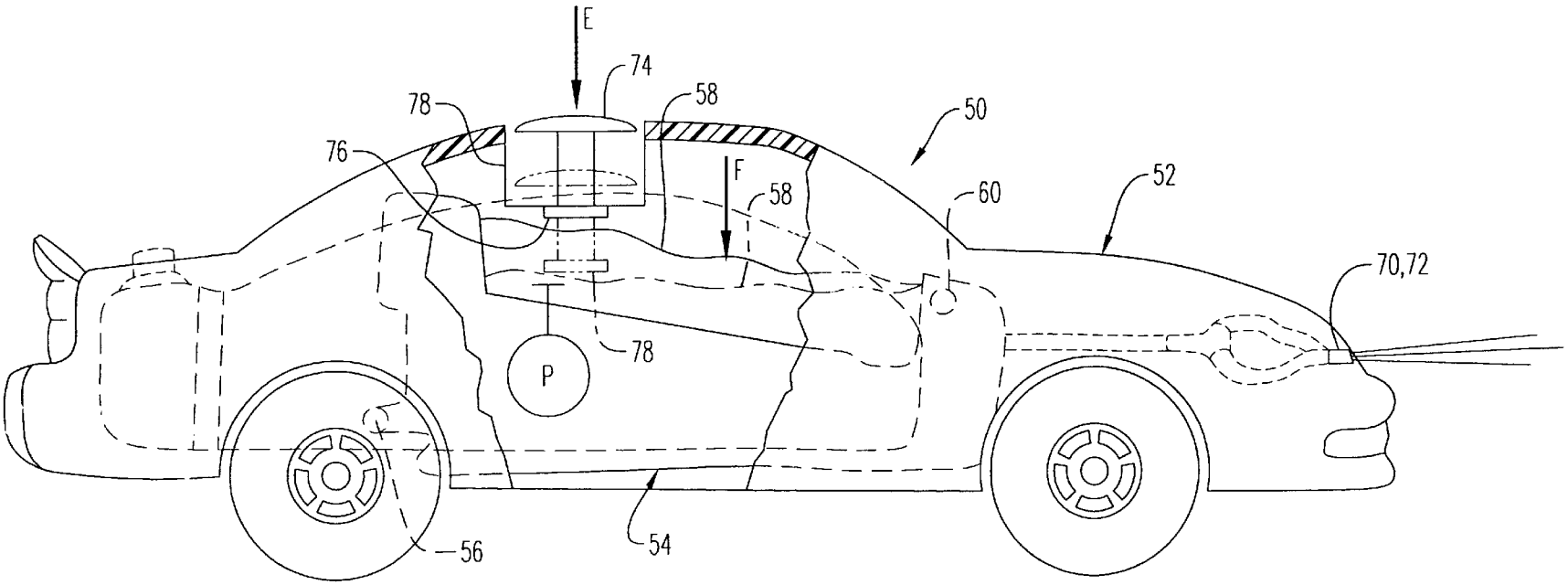
FIG. 5 is a broken view similar to FIG. 4 showing the grip in the stored position and begin actuated by a manually depressable panel area of the vehicle.

Referring now to FIGS. 4 and 5, the preferred embodiment of the invention is shown generally at numeral 50. This toy vehicle 50 includes a molded plastic body 52 and a grip 54 which is pivotally connected to the body 52 at 56. The grip 54 itself includes a pump lever 58 which is pivotally connected at 60 and acts to energize pump 62 when squeezed in the direction of arrow D.

Wounded within the toy vehicle is a water tank 64 having a capable fill 66 for carrying a supply of water. The pump 62 is in fluid communication with the interior of the tank through conduit 67 and in fluid communication with injection nozzles 70 and 72 mounted at the headlight area of the toy vehicle 52 by conduit 68.

When the grip 54 is in the locked in-use position as shown in FIG. 4, squeezing of the pump lever 58 in the direction of arrow D results in water being discharged from each of the discharge nozzles 70 and 72.

As best seen in FIGS. 4 and 5, when the grip 54 is in the concealed position, having been pivoted thusly about pivot 56, the pump lever 58 in the relaxed position shown in solid lines is in dose proximity to a button actuator 74 which forms a portion of the exterior surface of the toy vehicle 52 When this button actuator 74 is depressed in the direction of arrow E, plate 78 moves to the position shown in phantom and forces the pump lever 58 into the position shown in phantom in the direction of arrow 8. By this arrangement, even when the grip 54 is in the stored position, water may be discharged from the nozzles 70 and 72 with the car sitting on the ground in a normal toy vehicle fashion.

Referring now to FIGS. 6 and 7, a simplistic embodiment of the invention is there shown at numeral 80 and includes a shell body 82 formed of thin molded plastic and a modified squirt gun shown generally at 84. The squirt gun 84 includes a conventional trigger 86 actuating an internal water pump (not shown) which draws water from the reservoir 88. The water is discharged from the squirt gun upon actuation of trigger 86 through conduit 92 which is split into two discharge nozzles 94 and 96 based apart a distance generally equal to apertures formed into the front of the vehicle shell 82 at approximately the normal position of headlights of a real vehicle.

To retain the squirt gun 84 in position within the shell, a thin plate 90 is attached along the upper portion of the squirt gun and is sized to snugly mate within the perimeter of the vehicle shell 82.

The squirt gun 84 including a stopper 98 for filling the reservoir 88, can either be made permanently connected within the vehicle shell 82 or may be moveable simply by tight frictional engagement between the perimeter of plate 90 and the interior contour of the toy vehicle shell 82.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A combination miniature toy vehicle and squirt gun, the toy vehicle having two spaced apart simulated headlights displaced at the front of the vehicle, comprising:

a toy vehicle body including said spaced apart headlights, a water reservoir positioned within said body and a water discharge nozzle positioned for simultaneously discharging a stream of water from each of said headlights of said body;

a hand grip connected to, and extending downwardly from said body;

a water pump cooperatively positioned in said hand grip and operatively connected by a water conduit extending within said body to said reservoir whereby, when said grip is manually actuated, a supply of water is drawn from said reservoir for discharge as a stream of water from each of said discharge nozzles.

2. A combination miniature toy vehicle and squirt gun as set forth in claim 1, wherein:

said body includes a cavity;

said grip pivotally connected to, and pivotally extendable downwardly from, said body whereby said grip is pivoted upwardly into a stored position within said cavity enabling normal use of said toy vehicle.

3. A combination miniature toy vehicle and squirt gun as set forth in claim 2, further comprising:

a separate actuator positioned in, and movable with respect to, an outer rear surface of said body, said actuator operably connected to said pump whereby water streams discharge from said discharge nozzles when said actuator is manually depressed by finger or thumb pressure applied thereagainst.

4. A combination miniature toy vehicle and squirt gun comprising:

a toy car body having a cavity formed therein and including spaced apart headlights disposed at a front of said car body, a water reservoir positioned within said body and a water discharge nozzle positioned at each said headlight for discharge of a stream of water therefrom;

a hand grip pivotally connected to, and extendable downwardly from said body from a stored positioned within said cavity in said body into a downwardly extended operative position;

a manually squeezable water pump cooperatively positioned in said hand grip and operatively connected by a conduit to said reservoir whereby, when said hand grip is in the operative position, a supply of water is discharged as streams of water from each of said discharge nozzles each time said water pump is squeezed;

a separate pump actuator forming a moveable portion of a top of said body operably connected to said pump whereby water streams discharge from said discharge nozzles when said pump actuator is depressed.

5. A combination miniature toy vehicle and squirt gun, said vehicle including spaced apart simulated headlights, said vehicle comprising:

a toy vehicle body including said spaced apart headlights, a water reservoir positioned within said body and a water discharge nozzle at each of said headlights each of said discharge nozzles for discharging a stream of water therefrom;

a hand grip connected to, and extending downwardly from said body;

a water pump cooperatively positioned in said body and operatively connected to draw water from said reservoir;

a water pump actuator forming a portion of an outer surface of said body, said actuator operably connected to said pump whereby, when said actuator is depressed, a supply of water is drawn from said reservoir by said pump for discharge as streams of water from said discharge nozzles.

* * * * *